US007886911B1

(12) United States Patent
McLaughlin

(10) Patent No.: US 7,886,911 B1
(45) Date of Patent: Feb. 15, 2011

(54) CORRUGATED CONTAINER WITH INTEGRAL DUNNAGE

(75) Inventor: Brian C. McLaughlin, Burt, MI (US)

(73) Assignee: Security Packaging, Inc., Flint, MI (US)

( * ) Notice: Subject to any disclaimer, the term of this patent is extended or adjusted under 35 U.S.C. 154(b) by 571 days.

(21) Appl. No.: 11/825,709

(22) Filed: Jul. 9, 2007

(51) Int. Cl.
*B65D 5/50* (2006.01)
*B65D 5/00* (2006.01)

(52) U.S. Cl. ..... 206/756; 206/521; 229/120.15

(58) Field of Classification Search ..... 206/586, 206/395, 485, 756, 775, 521, 591, 592, 758, 206/759, 736, 762, 757; 229/120.15, 120.18
See application file for complete search history.

(56) References Cited

U.S. PATENT DOCUMENTS 1,640,368 A * 8/1927 Obetz et al. ..... 206/409
2,132,785 A * 10/1938 Hill ..... 108/165
2,609,136 A 9/1952 Sider
2,870,949 A * 1/1959 Currivan ..... 206/591
2,913,101 A 11/1959 Daily
3,162,351 A * 12/1964 Rudofski ..... 229/122
3,896,932 A * 7/1975 Giebel et al. ..... 206/335
5,000,376 A 3/1991 Wojdyla
5,005,705 A * 4/1991 Combs ..... 206/586
5,242,107 A 9/1993 De Nola
5,332,097 A * 7/1994 Wile ..... 206/554
5,356,251 A 10/1994 Sisco et al.
5,505,309 A 4/1996 Taravella et al.
5,529,187 A 6/1996 DeNola
5,622,258 A * 4/1997 Baublitz et al. ..... 206/349
5,996,804 A 12/1999 Kuhn et al.
7,604,119 B2 * 10/2009 Schott et al. ..... 206/454
2005/0284782 A1 * 12/2005 Nago ..... 206/315.11
2006/0049240 A1 * 3/2006 LeBras ..... 229/120.15

* cited by examiner

*Primary Examiner*—Mickey Yu
*Assistant Examiner*—Steven A. Reynolds
(74) *Attorney, Agent, or Firm*—Young Basile Hanlon & MacFarlane, P.C.

(57) ABSTRACT

A corrugated container with integral dunnage for securing a cargo element with respect to the interior of the corrugated container, including at least one wall panel having a substantially planar surface, an aperture defined in the substantially planar surface, and a flap portion connected to the substantially planar surface adjacent to the aperture. The flap portion is subdivided into a plurality of sections that cooperate to define a dunnage element.

17 Claims, 4 Drawing Sheets

CORRUGATED CONTAINER WITH INTEGRAL DUNNAGE

FIELD OF THE INVENTION

The present invention relates to the field of corrugated containers with integral dunnage, and more particularly, the present invention relates to a corrugated container having an integral, triangular-shaped dunnage pad.

BACKGROUND OF THE INVENTION

In many packaging applications, it is known to provide pads or blocks on the interior surfaces of corrugated containers to secure a cargo element shipped inside the corrugated container at a particular position within the corrugated container. Such an arrangement is particularly useful in shipping applications where fragile goods are being shipped. Consequently, many structures have been previously employed to secure goods within a corrugated container, and those structures vary greatly in both design and materials.

Corrugated containers having integral dunnage have been previously proposed. In one such corrugated container, the length of the corrugated cardboard blank from which the container is formed is extended to provide sections that are folded into dunnage elements. This structure increases the amount of material that is required to fabricate a corrugated cardboard container and thus increases the cost of the corrugated container.

It would be desirable to have a corrugated container with integral dunnage, wherein the size of the corrugated cardboard blank is not increased to provide for the dunnage elements.

SUMMARY OF THE INVENTION

The present invention provides a corrugated container with integral dunnage for securing a cargo element with respect to the corrugated container. The corrugated container includes at least one wall panel having a substantially planar surface, wherein an aperture is defined in the substantially planar surface. Furthermore, the aperture may be disposed at an intermediate location on the substantially planar surface. A flap portion is connected to the substantially planar surface adjacent the aperture. The flap portion is subdivided into a plurality of sections that cooperate to define a dunnage element. Furthermore, the plurality of sections may include a first section, a second section, and a third section that cooperate to define a substantially triangular dunnage element.

In order to provide the substantially triangular dunnage element, the first section, the second section and the third section of the flap portion extend at acute angles with respect to one another. More particularly, the first section of the flap portion is adjacent to the aperture and extends at an acute interior angle with respect to the substantially planar surface of the at least one wall panel, the second section of the flap portion extends substantially perpendicular to the substantially planar surface of the at least one wall panel and is disposed intermediate the first and third sections, and the third section of the integral flap portion is substantially parallel to and abutting the substantially planar surface of the at least one wall panel.

To secure the triangular dunnage element, the third section of the flap portion is affixed to the substantially planar surface of the at least one wall panel. Also, the at least one wall panel and the flap portion may be formed integrally. Additionally, the integral flap portion and the aperture may be substantially identical in size.

BRIEF DESCRIPTION OF THE DRAWINGS

The description herein makes reference to the accompanying drawings, wherein like-referenced numerals refer to like parts throughout several views and wherein.

DETAILED DESCRIPTION OF THE INVENTION

Figure 1:
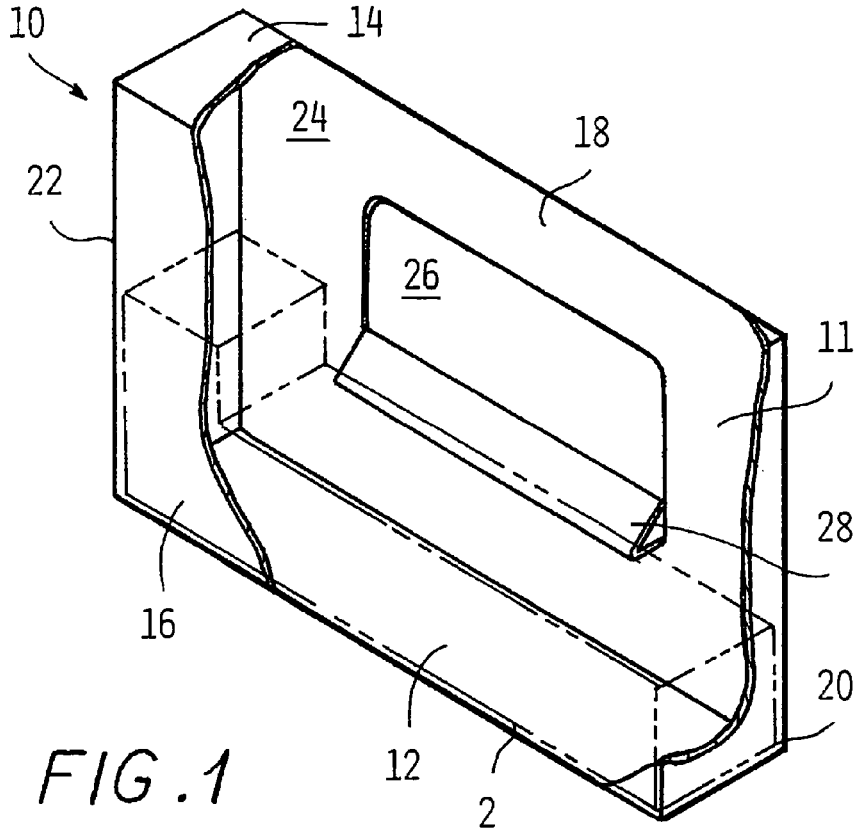
FIG. 1 is a cut-away perspective view showing a corrugated container with integral dunnage of the present invention.

Referring to the drawings, the present invention will now be described in detail with reference to the disclosed embodiment.

FIG. 1 shows a corrugated container 10 with integral dunnage of the present invention. The corrugated container 10 is defined by a plurality of substantially planar corrugated wall panels that cooperate to define a substantially rectangular enclosure. In particular, the corrugated container 10 includes a bottom panel 12, a top panel 14 opposite the bottom panel 12, a first side panel 16, a second side panel 18 opposite the first side panel 16, a first end panel 20, and a second end panel 22 opposite the first end panel 20.

At least one aperture 26 is formed through a substantially planar surface 24 defined on one of the walls panels 12, 14, 16, 18, 20, 22. In order to stabilize a cargo element 2 with respect to the corrugated container 10, a substantially-triangular dunnage element 28 is located adjacent to the aperture 26 and formed integrally with the substantially planar surface 24. The aperture 26 also acts as a window to allow viewing of an interior 11 of the corrugated container 10, so that securement of the cargo element 2 can be verified. Furthermore, even though the dunnage element 28 is described herein as substantially triangular, the dunnage element 28 could be provided in other shapes as well.

Figure 2:
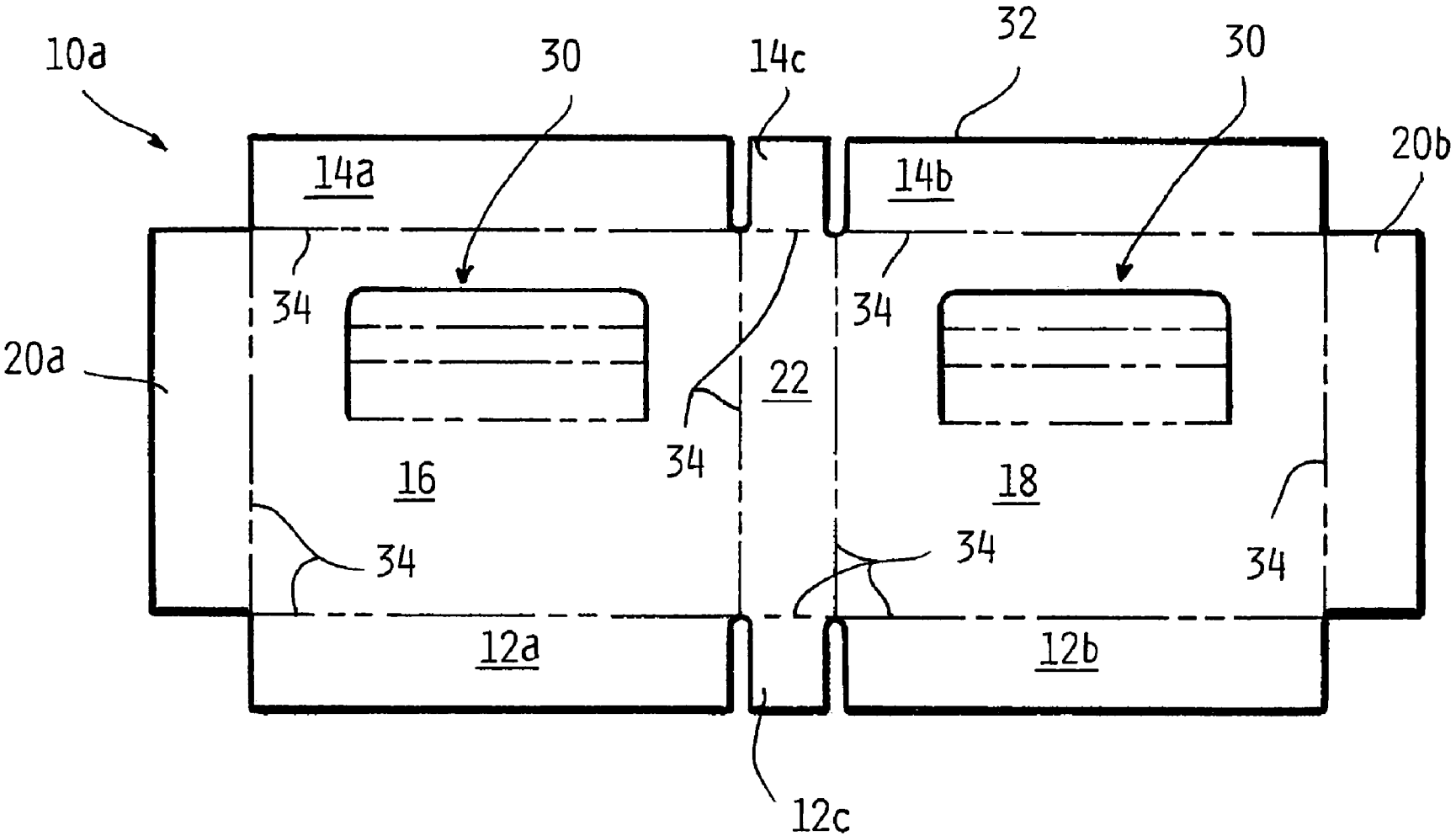
FIG. 2 is an illustration of a blank from which the corrugated container with integral dunnage of the present invention is fabricated.

So that the corrugated container 10 may be conveniently shipped and stored prior to use, the corrugated container 10 is fabricated from a substantially planar blank 10*a*, as shown in FIG. 2. The blank 10*a* is a substantially planar expanse of corrugated cardboard material having a shape defined by an irregular perimeter 32, which partially separates the various portions of the blank 10*a* from one another, as will be described herein. The blank 10*a* is further divided by a plurality of fold lines 34 along which the blank 10*a* is folded to provide the wall panels 12, 14, 16, 18, 20, 22 of the corrugated container 10. The second end panel 22 is located at the center of the blank 10*a* and is flanked on either side by the first side panel 16 and the second side panel 18, which are each foldable with respect to the second end panel 22 at the fold lines 34. The first end panel 20 is formed from a first portion 20*a* and a second portion 20*b* disposed on opposite sides of the blank 10*a*, adjacent to the first side panel 16 and the second side panel 18, at the respective fold lines 34. The bottom panel 12 is formed from a first portion 12*a* that is located adjacent to the first side panel 16 at a fold line 34, a second portion 12*b* that is located adjacent to the second side panel 18 at a fold line 34, and a third portion 12*c* that is located adjacent to the second end panel 22 at a fold line 34. In a similar manner, the top panel 14 is formed from a first portion 14*a*, a second portion 14*b*, and a third portion 14*c* that are adjacent to the first side panel 16, the second side panel 18, and the second end panel 22, at respective fold lines 34.

Figure 3:
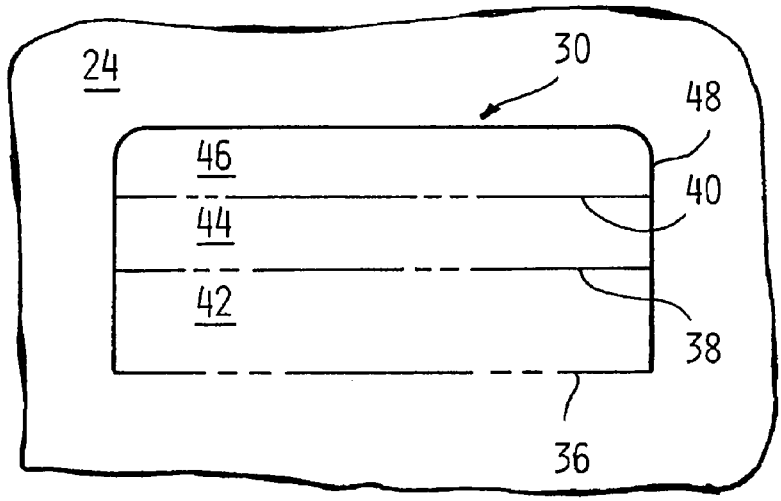
FIG. 3 is a detail view of the blank of FIG. 2 showing a flap portion thereof.

In order to provide the triangular dunnage elements 28 from the blank 10*a*, a flap portion 30 is defined in each of the first side panel 16 and the second side panel 18 on the blank 10*a*. As best shown in FIG. 3, each flap portion 30 is substantially rectangular and connected to a respective substantially planar surface 24 of either the first side panel 16 or the second side panel 18 at a first fold line 36 that extends along one edge of the flap portion 30. The remaining three edges of the flap portion 30 are separated from the rest of the substantially planar surface 24 by a score or cut 48 which defines a substantially U-shaped semi-perimeter of the flap portion 30. In addition, when the corrugated container 10 is assembled, the cut 48 defines the perimeter of the aperture 26. In addition to being foldable with respect to the substantially planar surface 24 at the first fold line 36, the flap portion 30 is sub-divided into a plurality of sections 42, 44, 46 by a plurality of fold lines 38, 40. In particular, the flap portion 30 is sub-divided by a second fold line 38 and a third fold line 40 to define a first section 42, which is bordered by the first fold line 36 and the second fold line 38; a second section 44, which is bordered by the second fold line 38 and the third fold line 40; and a third section 46, which is bordered by the third fold line 40 and has a free end at the cut 48. Of course, where the dunnage element 28 is not substantially triangular, the flap portion 30 may be sub-divided into as many sections as needed.

Figure 4:
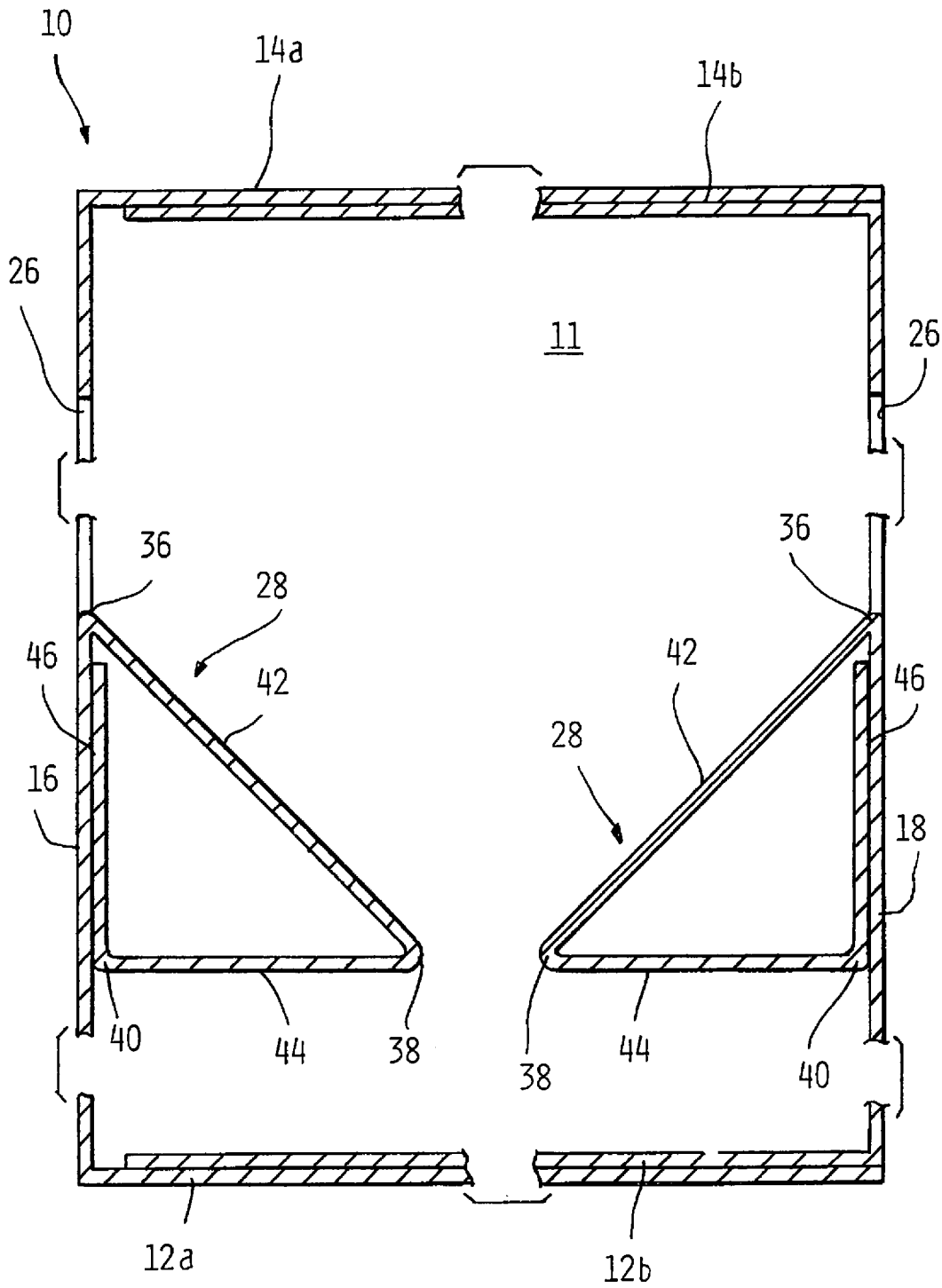
FIG. 4 is a sectional view of the corrugated container with integral dunnage of the present invention.

To construct the corrugated container 10 from the blank 10*a*, the blank 10*a* is folded and the appropriate portions thereof are affixed to one another in a conventional manner. In particular, the first side panel 16 and the second side panel 18 are each folded substantially perpendicular to the second end panel 22 at the fold lines 34. The portions 12*a*-12*c* of the bottom panel 12 are folded so that they substantially overlie one another and are affixed to one another in a conventional manner. Likewise, the portions 14*a*-14*c* of the top panel 14 are folded so that they substantially overlie one another and are affixed to one another in a conventional manner. Finally, the portions 20*a*-20*b* of the first end panel 20 may be affixed to one another or otherwise secured in place in order to close the corrugated container 10. Of course, this step is typically performed after the cargo element 2 is disposed within the corrugated container 10. Once the blank 10*a* is folded to define the corrugated container 10, the interior 11 is defined within the corrugated container 10 in the folded configuration thereof, as shown in FIG. 4.

In order to secure the cargo element 2 within the corrugated container 10, the flap portions 30 are folded from a first position, wherein the first through third sections 42, 44, 46 of each flap portion 30 are substantially coplanar and substantially occupy the aperture 26, to a second position, wherein the first through third sections 42, 44, 46 of each flap portion 30 cooperate to define the substantially triangular dunnage elements 28. Thus, in the second position, the substantially triangular dunnage elements 28 extend into the interior 11 of the corrugated container 10. In particular, the first section 42 of the flap portion 30 extends at an acute interior angle with respect to a respective side wall 16, 18 of the corrugated container 10. The second section 44 forms an acute interior angle with respect to the first section 42. Furthermore, the second section 44 extends substantially perpendicular to a respective side wall 16, 18. The third section 46 extends substantially perpendicular to the second section 44 and abuts a respective wall portion 16, 18. Furthermore, the third section 46 is adhered or otherwise affixed to a respective wall portion 16, 18 of the corrugated container 10 by, for example, a layer of adhesive (not shown). The first, second, and third sections 42, 44, 46 of the dunnage elements 28 cooperate to define a substantially triangular cross-section. With further reference to FIG. 4, it should be understood that similar triangular dunnage elements 28 may be provided on each of the side walls 16, 18 of the corrugated container 10. However, it should be recognized that while the embodiment described herein contemplates triangular-dunnage element 28 on each of the side walls 16, 18, the invention is not so limited, but rather, a triangular dunnage element 28 could be provided in other numbers or configurations within the scope of this invention.

Figure 5:
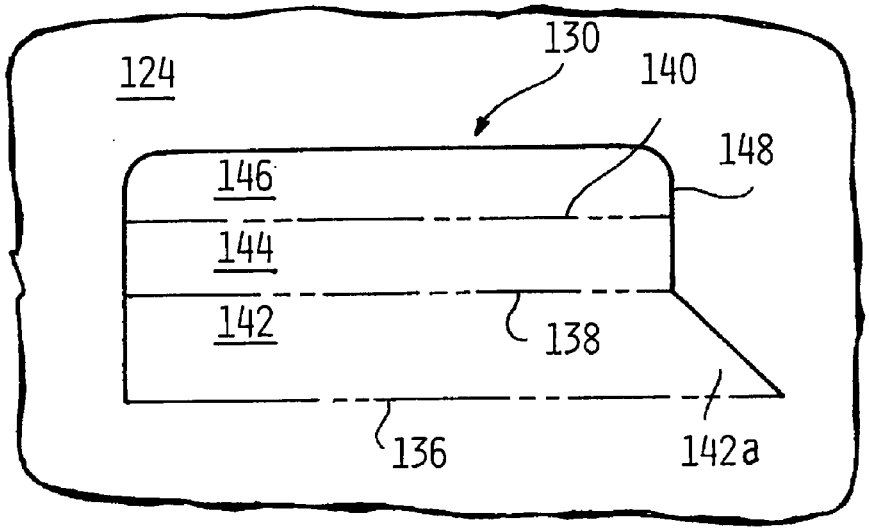
FIG. 5 is a detail view of a blank showing an alternative flap portion.
Figure 6:
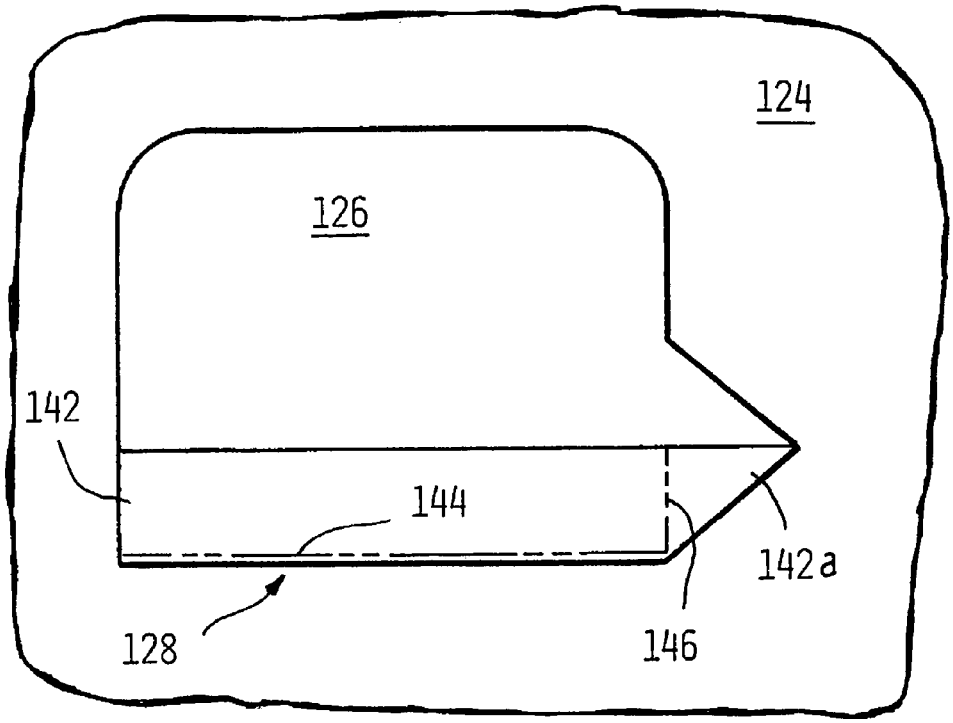
FIG. 6 is a side view of a dunnage element constructed from the blank of FIG. 5.

By an alternative embodiment, a tapered triangular dunnage element 128 may be formed on the blank 10*a* by providing a flap portion 130 having a score or cut 148 that defines a tapered portion 142*a* of a first section 142 of the flap portion 130, as shown in FIGS. 5-6. The flap portion 130 is similar to the previously described flap portion 30 and is connected to a respective substantially planar surface 124 of either the first side panel 16 or the second side panel 18 at a first fold line 136 that extends along one edge of the flap portion 130. The remaining three edges of the flap portion 130 are separated from the rest of the substantially planar surface 124 by the score or cut 148 which defines the perimeter of the flap portion 130. When the corrugated container 10 is assembled, the cut 148 defines the perimeter of an aperture 126. In addition to being foldable with respect to the substantially planar surface 124 at the first fold line 136, the flap portion 130 is sub-divided by a second fold line 138 and a third fold line 140 to define the first section 142, which is bordered by the first fold line 136 and the second fold line 138, a second section 144, which is bordered by the second fold line 138 and the third fold line 140, and a third section 146, which is bordered by the third fold line 140 and has a free end at the cut 148. The tapered triangular dunnage element 128 is assembled in substantially the same manner as described with respect to the triangular dunnage element 28, and thus extends into the interior 11 of the assembled corrugated container 10 to secure a cargo element 2 with respect thereto. By providing the tapered portion 142*a* on the first section 142 of the flap portion 130, cargo elements 2 may be accommodated even if they have irregular geometries.

In use, a user wishing to secure a cargo element 2 forms the corrugated container 10 from the blank 10*a* as described herein. The flap portions 30 are then moved from the first position to the second position to form the substantially triangular dunnage elements 28. The cargo element 2 is then disposed within the corrugated container 10 and secured by the substantially triangular dunnage elements 28. Finally, the first and second portions 20*a*, 20*b* of the first end panel 20 may be secured with respect to one another to retain the cargo element 2 within the corrugated container 10.

While the invention has been described in connection with what is presently considered to be the most practical and preferred embodiment, it is to be understood that the invention is not to be limited to the disclosed embodiments, but to the contrary, it is intended to cover various modifications or equivalent arrangements included within the spirit and scope of the appended claims. The scope is to be accorded the broadest interpretation so as to encompass all such modifications and equivalent structures as is permitted under the law.

What is claimed is:

1. A corrugated container with integral dunnage for securing a cargo element with respect to the interior of the corrugated container, comprising:

a first wall panel having a substantially planar configuration;

an aperture defined in said first wall panel such that a periphery of the aperture lies in a substantially common plane;

a flap portion connected to said first wall panel adjacent to said aperture;

said flap portion subdivided into a first section, a second section, and a third section, wherein said first section is adjacent to said aperture, said third section is affixed to said first wall panel, said second section is disposed intermediate said first and third sections, and said first, second, and third sections cooperate to define a dunnage element;

said first wall panel having an outer periphery, wherein said aperture is spaced from said outer periphery such that said aperture is disposed at an intermediate location on said first wall panel and such that an engaging portion of said first wall panel is defined between said dunnage element and said outer periphery of said first wall panel, the engaging portion of said first wall panel being engageable with the cargo element; and a second wall panel that is connected to said first wall panel at said outer periphery thereof such that said second wall panel is spaced from said dunnage element by said engaging portion of said first wall panel, wherein said dunnage element and said second wall panel are engageable with the cargo element to restrain the cargo element against moving with respect to said engaging portion of said first wall panel.

2. The corrugated container stated in claim 1, wherein said first section, said second section and said third section of said flap portion extend at acute angles with respect to one another.

3. The corrugated container stated in claim 1, wherein said third section of said flap portion is substantially coplanar to said first wall panel.

4. The corrugated container stated in claim 1, wherein said first wall panel and said flap portion are formed integrally.

5. The corrugated container stated in claim 4, wherein said first section of said integral flap portion extends at an acute interior angle with respect to first wall panel, said second section of said integral flap portion extends substantially perpendicular to first wall panel, and said third section of said integral flap portion is substantially parallel to and abutting said first wall panel.

6. The corrugated container stated in claim 4, wherein said integral flap portion and said aperture are substantially identical in size.

7. The corrugated container stated in claim 1, wherein said dunnage element is substantially triangular.

8. A corrugated container with integral dunnage for securing a cargo element with respect to the interior of the corrugated container, comprising:

a first wall panel having a substantially planar configuration;

an aperture defined in said first wall panel;

an integral flap portion extending from said first wall panel adjacent to said aperture;

said integral flap portion subdivided into a first section, a second section, and a third section, wherein said first section is adjacent to said aperture, said third section is affixed to said first wall panel, said second section is disposed intermediate said first and third sections, and said first, second, and third sections cooperate to define a substantially triangular dunnage element;

said first wall panel having an outer periphery, wherein said aperture is spaced from said outer periphery such that said aperture is disposed at an intermediate location on said first wall panel and such that an engaging portion of said first wall panel is defined between said dunnage element and said outer periphery of said first wall panel, the engaging portion of said first wall panel being engageable with the cargo element; and a second wall panel that is connected to said first wall panel at said outer periphery thereof such that said second wall panel is spaced from said dunnage element by said engaging portion of said first wall panel and such that said second wall panel extends substantially perpendicular to said first wall panel, wherein said dunnage element and said second wall panel are engageable with the cargo element to restrain the cargo element against moving with respect to said engaging portion of said first wall panel.

9. The corrugated container stated in claim 8, wherein said first section, said second section and said third section of said integral flap portion extend at acute angles with respect to one another,.

10. The corrugated container stated in claim 8, wherein said first section of said integral flap portion extends at an acute interior angle with respect to said first wall panel, said second section of said integral flap portion extends substantially perpendicular to said first wall panel, and said third section of said integral flap portion is substantially parallel to and abutting said first wall panel.

11. The corrugated container stated in claim 8, wherein said integral flap portion and said aperture are substantially identical in size.

12. The corrugated container stated in claim 8, wherein said substantially triangular dunnage element is disposed within the interior of the corrugated container.

13. A corrugated container with integral dunnage for securing a cargo element with respect to the interior of the corrugated container, comprising:

a first wall panel having a substantially planar configuration;

an aperture defined in said first wall panel; and an integral flap portion extending from said first wall panel adjacent to said aperture and subdivided into a first section, a second section, and a third section, wherein said integral flap portion is foldable from a first position, wherein said first section, said second section, and said third section are substantially coplanar and substantially occupy said aperture, to a second position, wherein said first section, said second section, and said third section cooperate to define a substantially triangular dunnage element;

said first wall panel having an outer periphery, wherein said aperture is spaced from said outer periphery such that said aperture is disposed at an intermediate location on said first wall panel and such that an engaging portion of said first wall panel is defined between said dunnage element and said outer periphery of said first wall panel, the engaging portion of said first wall panel being engageable with the cargo element; and a second wall panel that is connected to said first wall panel at said outer periphery thereof such that said second wall panel is spaced from said dunnage element by said engaging portion of said first wall panel and such that said second wall panel extends substantially perpendicular to said first wall panel, wherein said dunnage element and said second wall are engageable with the cargo element to restrain the cargo element against moving with respect to said engaging portion of said first wall panel.

14. The corrugated container stated in claim 13, wherein said first section, said second section and said third section of said flap portion extend at acute angles with respect to one another when said integral flap portion is in said second position.

15. The corrugated container stated in claim 13, wherein said first section of said integral flap portion is adjacent to said aperture, said third section is abuts said first wall panel when said integral flap portion is in said second position, and said second section is disposed intermediate said first and third sections.

16. The corrugated container stated in claim 15, wherein when said integral flap portion is in said second position, said first section of said integral flap portion extends at an acute interior angle with respect to said first wall panel, said second section of said integral flap portion extends substantially perpendicular to said first wall panel, and said third section of said integral flap portion extends substantially parallel to said first wall panel.

17. The corrugated container stated in claim 13, wherein said substantially triangular dunnage element is disposed within the interior of the corrugated container.

* * * * *

UNITED STATES PATENT AND TRADEMARK OFFICE

CERTIFICATE OF CORRECTION

PATENT NO. : 7,886,911 B1
APPLICATION NO. : 11/825709
DATED : February 15, 2011
INVENTOR(S) : McLaughlin It is certified that error appears in the above-identified patent and that said Letters Patent is hereby corrected as shown below:

1. In Col. 5, line 41, please delete “to first” and insert --to said first--;

2. In Col. 5, line 43, please delete “to first” and insert --to said first--;

3. In Col. 6, line 20, please delete “another,.” and insert --another.--;

4. In Col. 6, line 66, please delete “wall are” and insert --wall panel are--; and 5. In Col. 7, line 10, please delete “section is abuts” and insert --section abuts--.

Signed and Sealed this
Nineteenth Day of April, 2011

David J. Kappos

David J. Kappos
*Director of the United States Patent and Trademark Office*